US008268052B2

(12) United States Patent
Qiu et al.

(10) Patent No.: US 8,268,052 B2
(45) Date of Patent: Sep. 18, 2012

(54) WALL ASSEMBLY

(75) Inventors: Xin Qiu, Mississauga (CA); Meiring Beyers, Hamilton (CA); Michael Roth, Guelph (CA); Mark Vanderheyden, Waterloo (CA); Scott Shayko, Guelph (CA)

(73) Assignee: RWDI Air Inc., Guelph, ON (CA)

( * ) Notice: Subject to any disclaimer, the term of this patent is extended or adjusted under 35 U.S.C. 154(b) by 0 days.

(21) Appl. No.: 13/240,484

(22) Filed: Sep. 22, 2011

(65) Prior Publication Data

US 2012/0006203 A1 Jan. 12, 2012

Related U.S. Application Data

(62) Division of application No. 12/236,137, filed on Sep. 23, 2008, now Pat. No. 8,048,204.

(51) Int. Cl.
*B01D 45/00* (2006.01)

(52) U.S. Cl. ..... 95/267; 256/24

(58) Field of Classification Search ..... 95/267; 256/24

See application file for complete search history.

(56) References Cited

U.S. PATENT DOCUMENTS

| | | | |
|---|---|---|---|
| 4,095,669 | A | 6/1978 | Bond, Sr. |
| 4,136,856 | A | 1/1979 | Murdock |
| 4,471,924 | A | 9/1984 | Lynn |
| 4,513,840 | A | 4/1985 | Johnson |
| 5,429,324 | A | 7/1995 | Lynn |
| 5,856,640 | A | 1/1999 | Lynn |
| 5,959,265 | A | 9/1999 | Van Ligten |
| 6,152,428 | A | 11/2000 | Simioni |
| 6,253,872 | B1 | 7/2001 | Neumann |
| 6,260,319 | B1 | 7/2001 | Colomban |
| 6,877,721 | B2 | 4/2005 | Calverley |

FOREIGN PATENT DOCUMENTS

JP 2003313827 A * 11/2003

* cited by examiner

*Primary Examiner* — Robert A Hopkins

(57) ABSTRACT

A wall assembly for mixing polluted air with less polluted air to provide moderately polluted air. The wall assembly includes means for dividing air from a roadway region into a lower part and an upper part, and means for permitting at least a portion of the upper part to flow substantially in one or more flow directions toward a leeward region. The wall assembly also includes means for directing the lower part substantially upwardly in a direction substantially transverse to the flow direction to intersect with the upper part and to mix the polluted air with the less polluted air, to provide the moderately polluted air proximal to the leeward area.

17 Claims, 12 Drawing Sheets

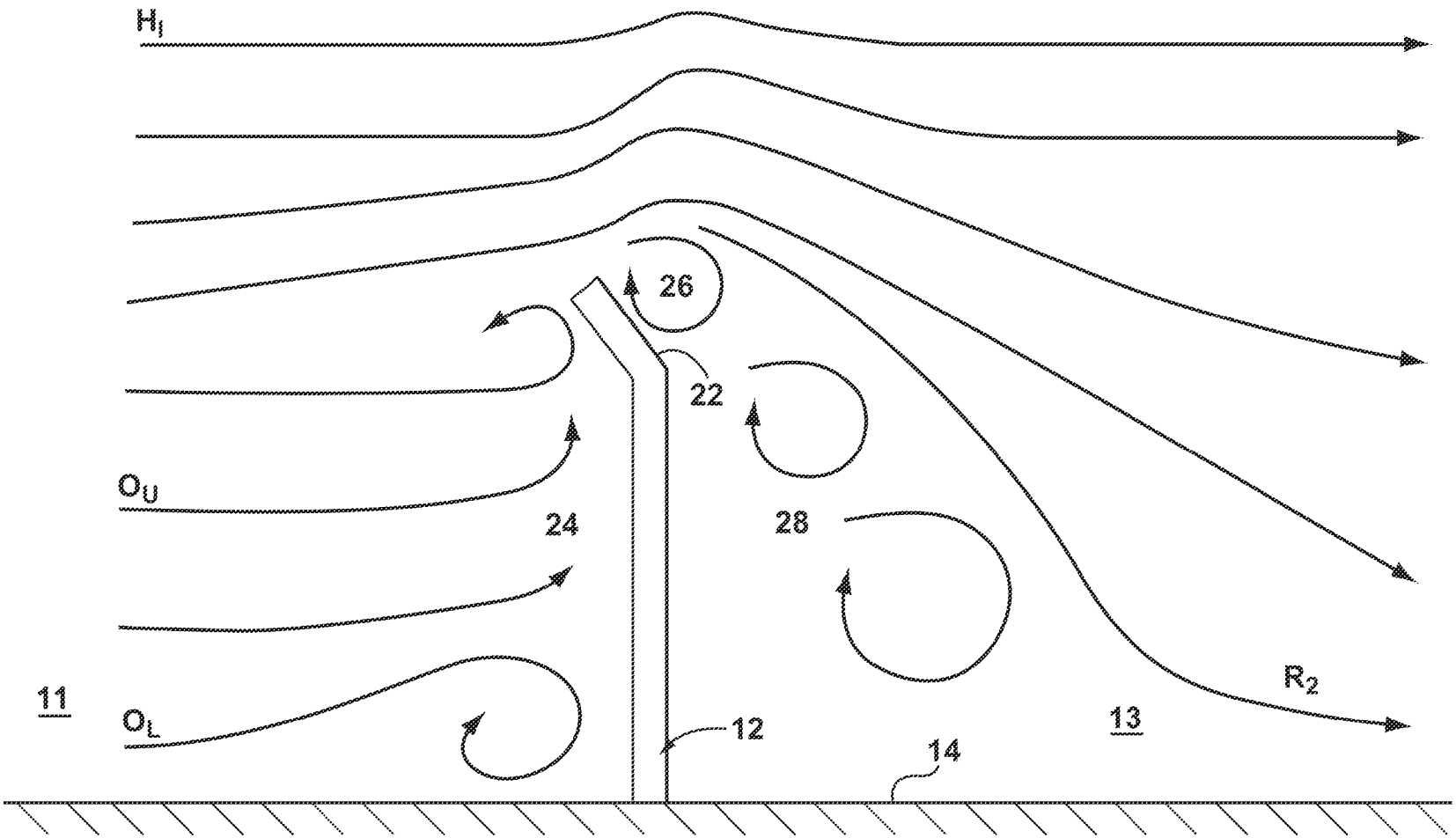
FIG. 2 (PriorArt)

WALL ASSEMBLY

This is a divisional application of application Ser. No. 12/236,137, filed on Sep. 23, 2008 now U.S. Pat. No. 8,048,204, and hereby incorporates such application in its entirety by reference.

FIELD OF THE INVENTION

This invention is related to a wall assembly for mixing polluted air from a roadway region with less polluted air to provide moderately polluted air disposed proximal to a leeward area.

BACKGROUND OF THE INVENTION

Vehicular pollutant concentrations within approximately 300 meters (approximately 984 ft.) of major highways frequently exceed minimum air quality criteria recommended or specified by government agencies (e.g., standards or guidelines). As is well known, vehicular emissions include pollutants such as carbon monoxide, oxides of nitrogen, particulate matter, and volatile organic compounds that are known to have human health effects. In addition to emissions from vehicular tailpipes, airborne pollutants emanate from the roadway surface, e.g., due to tire wear. For the purposes hereof, all airborne vehicular emissions and airborne pollutants emanating from the roadway surface are collectively referred to as "roadway pollutants".

In the prior art, mitigation (i.e., improvement) of air quality in the regions proximal to a busy roadway is generally not easily achievable. For example, a typical approach to mitigating air quality in the vicinity of a roadway is to purchase or expropriate land along the roadway, to provide larger regions (i.e., on both sides of the roadway) in which the roadway pollutants may disperse. In effect, this approach involves providing wider leeward regions along the roadway from which residences and businesses have been removed, e.g., via expropriation. The polluted air (i.e., air polluted by the roadway pollutants) from a region (the "roadway region") generally above the roadway is therefore required to travel further before reaching residences or businesses, and accordingly, the roadway pollutants are more likely to have been dispersed in the leeward region, i.e., before the polluted air from the roadway region reaches residences or businesses located adjacent thereto. However, this approach is impractical along many roadways, especially due to existing land uses proximal to older roadways. Even where this approach is not impractical, it is extremely expensive, and the process of obtaining the land may take several years.

Typically, costly and time-consuming environmental assessment proceedings are required to be successfully completed before construction of major new roadways (or major expansions of existing roadways, as the case may be) may proceed. Often, concerns about air quality in regions leeward to the roadway result in significant delays in an environmental assessment. However, as noted above, in the prior art, mitigation of air quality proximal to the roadway requires government acquisition of larger (leeward) areas of land along the roadway, i.e., where this is not impractical.

The prior art is schematically illustrated in FIGS. 1A, 1B, and 2. FIG. 1A shows the flow of polluted air from the roadway region toward the leeward region in the absence of any obstruction (e.g., a wall) mechanically affecting such flow of polluted air. As can be seen in FIG. 1A, in the absence of such an obstruction, the polluted air typically flows substantially parallel to the ground.

The impact of two different prior art walls on the flow of air from the roadway region is shown in FIGS. 1B and 2 respectively. The air flows schematically represented in FIGS. 1B and 2 were determined via computer-generated modelling using computational fluid dynamics software.

Most tailpipe emissions from automobiles and light trucks are released at a certain height (e.g., about 0.5 meters above the roadway surface), and most tailpipe emissions from larger vehicles (e.g., trucks, buses) are released at a height of about 3 meters above the roadway surface. In addition, and as described above, certain airborne pollutants emanate from the roadway surface, and these roadway surface-related pollutants also are generally considered, for modelling purposes, to be released at about 0.5 meters above the roadway surface. Accordingly, for modelling purposes, the polluted air can be considered to have two sources, namely, a lower source (designated "$O_L$" in FIG. 1A) from which tailpipe emissions from automobiles and light trucks, and airborne pollutants emanating from the roadway surface are considered to be emitted, and an upper source (designated as "$O_U$" in FIG. 1A) from which tailpipe emissions from larger vehicles are considered to be emitted.

At different heights above the roadway, the air in the roadway region has been found to include different concentrations of roadway pollutants therein, with higher concentrations in lower regions and concentrations generally decreasing as height above the roadway increases. The polluted air (and the less polluted air) in the roadway region may be considered to be roughly divided into layers based on different concentrations of roadway pollutants. For example, in a typical roadway region, in a lower band identified in FIG. 1A (from the roadway surface to approximately two meters above the roadway), the concentration of pollutants typically may be about 50 $\mu g/m^3$. In a middle band, from about two meters to about four meters above the roadway, the concentration typically may be about 40 $\mu g/m^3$. Finally, in an upper band extending between about four meters and about six meters above the roadway, the concentration typically may be about 5 $\mu g/m^3$.

In the prior art, walls are often located beside busier roadways, in an attempt to address noise concerns. Such prior art walls are generally indicated by the reference numerals 10 and 12 in FIGS. 1B and 2 respectively. Such prior art walls are intended to reduce noise effects, i.e., to mitigate the extent to which noise from traffic on the roadway affects those living or working in regions leeward to the roadway.

However, modelling shows that the prior art walls 10, 12 affect the flow of polluted air from the roadway toward the leeward region. For example, based on such modelling, FIG. 1B schematically illustrates the effect which the prior art wall 10 has on polluted air flowing from a roadway region 11 to a leeward region 13. The wall 10 is a standard noise wall of the prior art.

For modelling purposes, as described above, the polluted air is considered to originate from two sources in the roadway region 11. These two sources are the lower source $O_L$ and the upper source $O_U$, described above. The lower source is assumed to be positioned about 0.5 meters above the ground surface 14. The lower source is intended to represent exhaust gases (and particulates) from automobile tailpipes and re-entrained roadway emissions, e.g., due to particulate matter on the roadway surface. For the purposes hereof, the emissions from automobile tailpipes and the roadway emissions are collectively referred to as "lower source pollutants". The upper source is positioned about 3 meters above the ground surface 14. The upper source is intended to represent exhaust from a truck or a bus from which exhaust gases (and particulates) are released at about 3 meters above the ground, and such pollutants are collectively referred to as "upper source pollutants".

In general, the larger particulates (i.e., TSP (total suspended particulates, meaning those sized less than about 44 μm.) and $PM_{10}$ (particulate matter sized less than about 10 μm.)) settle on the roadway side of the prior art wall 10. However, smaller particulates (i.e., $PM_{2.5}$ (particulate matter sized less than about 2.5 μm.)) tend to be carried over the wall 10, to settle on the leeward area.

As can be seen in FIG. 1B, much of the air flow from the lower source $O_L$ is blocked by the wall 10, resulting in relatively high positive pressure on the windward side of the wall 10, i.e., at 16. At the same time, air flow over the top of the wall 10 from the upper source $O_U$ tends to be somewhat separated at the leeward side of the wall (i.e., at 18) near the top of the wall, due to the wake effect. Turbulence (generally, at 20) results from the wake effect. This permits airborne contaminants (i.e., the particulate matter generally sized less than about 2.5 μm.) to mix and eventually to settle on the ground surface generally leeward of the wall 10.

As can be seen in FIG. 1B, the flow of air from the roadway region 11 which is at a height "$H_1$" above the noise wall 10 is undisrupted, i.e., where the wall-induced separation (indicated at 18) and turbulence (indicated at 20) can not reach to the height $H_1$.

Based on the modelling, and as schematically illustrated in FIG. 1B, the net effects of the wall 10 on movement of polluted air from the roadway are summarized as follows.

(a) The blocking effect of the wall 10 on air from the lower source tends to reduce concentrations, at a receptor "$R_1$", of the lower source pollutants.

(b) The separation of air flows and turbulence (at 18 and 20 in FIG. 1B) tends to increase concentrations of upper source pollutants at the receptor $R_1$.

The receptor $R_1$ is considered to be located at about 1.5 meters above ground level. This height for the receptor was selected because it is a height at which, in general, human beings inhale. It is therefore considered to be an appropriate location at which to measure a person's exposure to airborne roadway pollutants.

In summary, the prior art wall 10 results in somewhat higher concentrations of upper source pollutants in the leeward area. Based on the modelling, it appears that these higher concentrations are found in the leeward area within approximately 110 meters of the wall 10.

The concentration of the upper source pollutants in the leeward region is generally undesirable. It is particularly serious, however, in circumstances where large trucks and/or buses typically are collected on a part of a roadway, and segregated from other vehicles. These circumstances may occur, for example, where roadways cross international borders.

As can be seen in FIG. 2, the prior art wall 12 is substantially the same as wall 10, but with an angled part 22 positioned upon it. In FIG. 2, much of the air flow from the lower source $O_L$ is blocked by the wall 12, which also results in relatively high positive pressure on the windward side of the wall 12, i.e., at 24. At the same time, air flow over the top of the wall 12 from the upper source $O_U$ is significantly impeded by the angled part 22. However, as indicated in FIG. 2, part of the air flow from the upper source $O_U$ flows over the angled part 22. The air which flows over the angled part 22 tends to be somewhat separated at the leeward side of the wall (i.e., at 26) near the angled part 22, due to the wake effect. A negative pressure zone is created, and it appears that such negative pressure zone causes somewhat more turbulence mixing leeward of the wall 12 than had resulted from the straight wall 10, illustrated in FIG. 1B. Also, wind flow turbulence mixes down within the leeside wake (cavity) zone, allowing airborne contaminants (i.e., the particulate matter generally sized less than about 2.5 μm.) to settle in the region of the leeward area designated as 28.

As can be seen in FIG. 2, the flow of air from the roadway region which is at the height "$H_1$" above the noise wall 12 is slightly disrupted, due to stronger separation 26 and turbulence 28 by part 22.

Based on the modelling, and as schematically illustrated in FIG. 2, the net effects of the wall 12 on movement of polluted air from the roadway are summarized as follows.

(a) The blocking effect of the wall 12 on polluted air from the lower source $O_L$ (at 24) tends to reduce concentrations, at a receptor "$R_2$", of the lower source pollutants.

(b) The separation of air flows and turbulence (at 26 and 28 in FIG. 2) tends to increase concentrations of upper source pollutants at the receptor $R_2$.

As can be seen in FIG. 2, the receptor $R_2$ is considered to be located at about 1.5 meters above ground level.

In summary, the prior art wall 12 appears to have unintended results similar to the unintended results of the prior art wall 10 described above. In particular, the prior art wall 12 appears to result in somewhat higher concentrations of upper source pollutants in the leeward area. Based on modelling, it appears that these higher concentrations are found in the leeward area within approximately 90 meters of the wall 12.

SUMMARY OF THE INVENTION

For the reasons set out above, there is a need for an improved wall assembly to mitigate air quality in regions leeward to a roadway.

In its broad aspect, the invention provides a wall assembly for mixing polluted air with less polluted air to provide moderately polluted air. The polluted air includes one or more roadway pollutants in one or more elevated concentrations moving from a roadway region above a roadway toward a leeward region above a leeward area. The less polluted air includes the roadway pollutant(s) in one or more lower concentrations located distal to the roadway, and the moderately polluted air including the roadway pollutant(s) at a reduced concentration disposed proximal to the leeward area. The wall assembly includes an outer wall spaced apart from the roadway with an upper end thereof positioned a first predetermined height above the ground, and an inner wall disposed between the roadway and the outer wall. The inner wall includes a lower portion with a top end thereof positioned a second predetermined height above the ground, the lower portion extending between the top end and a bottom end thereof, and the lower portion being spaced apart from the outer wall by one or more preselected distances to at least partially define a first channel therebetween.

The inner wall additionally includes a deflector positioned at the top end of the lower portion. The deflector includes an upper end thereof positioned at a first preselected height above the ground to permit at least a portion of the less polluted air to pass over the upper end while the less polluted air moves from the roadway region toward the leeward region.

The lower portion is formed to at least partially define one or more apertures for directing a first part of the polluted air into the first channel, so that the first part of the polluted air is directed substantially upwardly thereby to mix with the less polluted air to provide the moderately polluted air proximal to the leeward area.

In another of its aspects, the invention provides an inner wall for positioning relative to an outer wall to provide a wall assembly for mixing polluted air with less polluted air to provide moderately polluted air. The outer wall includes an upper end thereof positioned a first height above the ground. The inner wall includes a lower portion positionable between the roadway and the outer wall, and the lower portion includes a top end thereof positioned at a second height above the ground. The second height is substantially equal to the first height. The lower portion extends between the upper end and a bottom end thereof. The lower portion is positionable spaced apart from the outer wall by one or more preselected distances to at least partially define a first channel therebetween. The inner wall also includes a deflector positioned at the top end of the lower portion. The deflector includes an upper end thereof positioned at a first preselected height above the ground to permit at least a portion of the less polluted air to pass over the upper end while the less polluted air moves from the roadway region toward the leeward region.

In addition, the lower portion is formed to at least partially define one or more apertures for directing a first part of the polluted air into the first channel, so that the first part of the polluted air is directed substantially upwardly thereby to mix with the less polluted air to provide the moderately polluted air proximal to the leeward area.

In yet another of its aspects, the invention provides another wall assembly for mixing polluted air with less polluted air to provide moderately polluted air. The wall assembly includes means for dividing air from the roadway region into a lower part and an upper part, and means for permitting at least a portion of the upper part to flow substantially in one or more flow directions toward the leeward region. The wall assembly also includes means for directing the lower part substantially upwardly in a direction substantially transverse to the flow direction(s) to intersect the upper part and to mix the polluted air with the less polluted air, to provide the moderately polluted air proximal to the leeward area.

BRIEF DESCRIPTION OF THE DRAWINGS

The invention will be better understood with reference to the attached drawings, in which:

FIG. 2 (also described previously) is a schematic diagram showing the effect of an alternate prior art wall on movement of polluted air from the roadway region toward the leeward region, based on computational fluid dynamics modelling;

DETAILED DESCRIPTION

Figure 3:
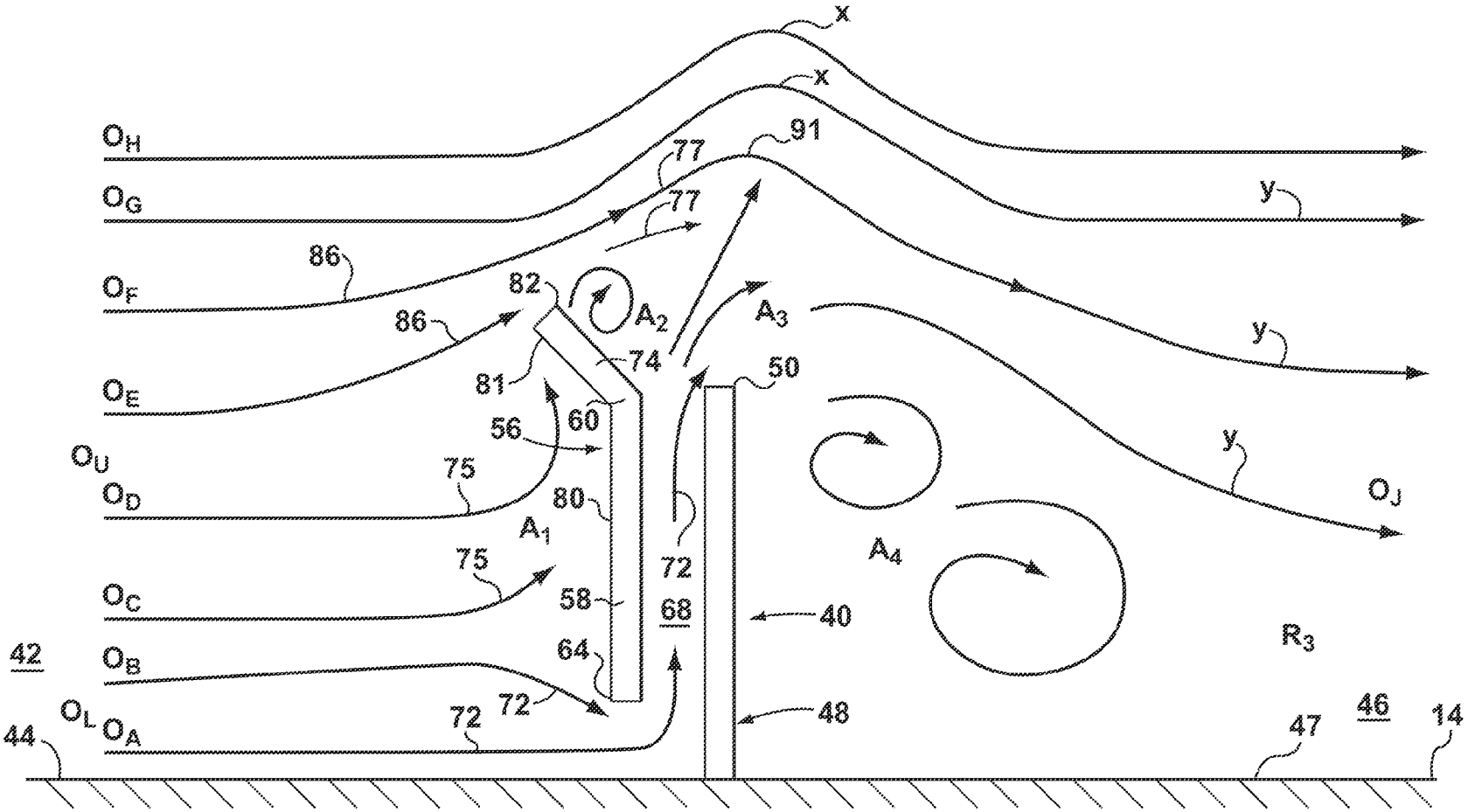
FIG. 3 is a schematic diagram showing the effect of an embodiment of a wall assembly of the invention on movement of polluted air from the roadway region toward the leeward region, based on computational fluid dynamics modelling.
Figure 4:
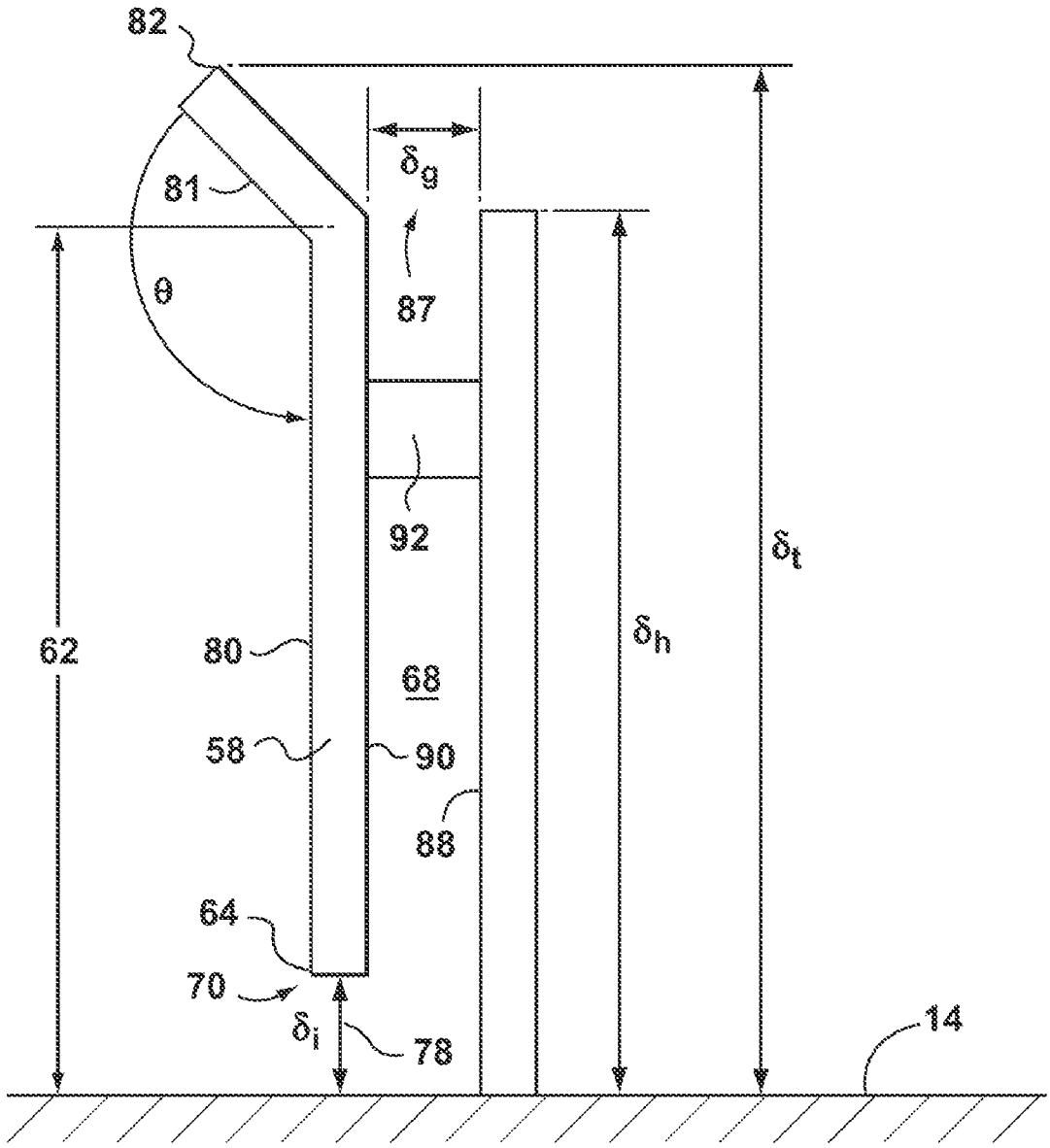
FIG. 4 is a cross-section of an embodiment of the wall assembly of the invention, drawn at a larger scale.

Reference is first made to FIGS. 3 and 4 to describe an embodiment of a wall assembly in accordance with the invention indicated generally by the numeral 40. As will be described, the wall assembly 40 is for mixing polluted air with less polluted air to provide moderately polluted air. The polluted air includes one or more roadway pollutants in one or more elevated concentrations, and the polluted air moves (or flows) from a roadway region 42 proximal to a roadway 44 toward a leeward region 46 substantially above a leeward area 47. The less polluted air includes the roadway pollutant(s) in one or more lower concentrations located distal to the roadway. The moderately polluted air includes the roadway pollutant(s) at a reduced concentration disposed proximal to the leeward area, as will be described.

In one embodiment, the wall assembly 40 preferably includes an outer wall 48 spaced apart from the roadway 44 with an upper end 50 thereof positioned a first predetermined height $\delta_h$ (FIG. 4) above the ground 14. The wall assembly 40 preferably also includes an inner wall 56 disposed between the roadway 44 and the outer wall 48. It is preferred that the inner wall 56 includes a lower portion 58 with a top end 60 thereof positioned a second predetermined height 62 (FIG. 4) above the ground 14. Preferably, the lower portion 58 is spaced apart from the outer wall 48 by one or more preselected distances $\delta_g$ (FIG. 4) to at least partially define a first channel 68 therebetween, as will also be described. It is also preferred that the inner wall 56 includes a deflector 74 positioned at the top end 60 of the lower portion 58. The deflector 74 preferably extends to an upper end 82 thereof positioned at a first preselected height $\delta_t$ (FIG. 4) above the ground 14 to permit at least a portion 86 of the less polluted air to pass over the upper end 82 while the less polluted air moves from the roadway region 42 to the leeward region 46. (The portion 86 is schematically represented by arrows in FIG. 3). It is also preferred that the lower portion 58 is formed to at least partially define one or more apertures 70 (FIG. 4) for directing a first part 72 of the polluted air moving from the roadway region 42 toward the leeward region 46 into the first channel 68 so that the first part 72 of the polluted air is directed substantially upwardly by the first channel 68 to mix with the less polluted air to provide the moderately polluted air proximal to the leeward area 47. (The first part 72 is schematically represented by arrows in FIG. 3.)

Preferably, the first and second predetermined heights $\delta_h$, 62 are substantially equal, i.e., so that the upper end 50 of the outer wall and the top end 60 of the lower portion 58 of the inner wall 56 are at approximately the same elevation.

In one embodiment, the bottom end 64 of the lower portion 58 of the inner wall 56 is positioned a second preselected height $\delta_i$ above the ground 14 to at least partially define the aperture 70 and a second channel 78 in communication therewith and in communication with the first channel 68, for directing the first part 72 of the polluted air into the first channel 68 (FIG. 4).

As described above, the concentrations of roadway pollutants in air in the roadway region 42 generally tend to vary from somewhat higher concentrations at lower levels (e.g., in the vicinity of the lower source $O_L$) to lower concentrations at higher elevations above the roadway 44. Accordingly, the air flows schematically represented by $O_E$, $O_F$, $O_G$, and $O_H$ are relatively less polluted air. Similarly, the air flows schematically represented by arrows $O_A$ and $O_B$ (and comprising the first part 72) are relatively more polluted air.

As shown in FIG. 3, air generally from a middle portion of the roadway region 42 flows generally toward the lower portion 58, schematically represented by arrows $O_C$ and $O_D$.

It is preferred that the deflector 74 is positioned for directing at least a second part 75 of the polluted air substantially upwardly, for mixing with the less polluted air (FIGS. 3, 4).

The mid-level air flowing from the roadway region 42 schematically represented by arrows $O_C$ and $O_D$ is directed upwardly by the surfaces 80, 81, so that such air mixes with the portion 86 of the less polluted air in the region "$A_2$", leeward of the deflector 74. The mixed air resulting from such mixing is less polluted than the first part 72.

Preferably, the lower portion 58 includes an exposed inner wall surface 80 adapted to direct the second part 75 of the polluted air substantially upwardly for mixing thereof with the portion 86 of the less polluted air.

It is preferred that the deflector 74 and the exposed inner wall surface 80 substantially define an obtuse dihedral angle θ therebetween substantially facing the roadway region 42 (FIG. 4). Specifically, the deflector 74 preferably includes a windward surface 81. The windward surface 81 and the exposed inner wall surface 80 substantially define the dihedral angle θ. Preferably, the dihedral angle θ is approximately 135°.

As can be seen in FIGS. 3 and 4, the first channel 68 ends in an upper opening 87 thereof which preferably is substantially defined by the top end 60 of the lower portion 58 and the upper end 50 of the outer wall 48.

In another embodiment, the outer wall 48 includes an outer wall channel surface 88 and the inner wall 56 includes an inner wall channel surface 90 facing the outer wall channel surface 88 (FIG. 4). The inner wall channel surface 90 and the outer wall channel surface 88 at least partially define the first channel 68.

As can be seen in FIG. 3, in general terms, the wall assembly 40 divides the polluted air flowing from the roadway region 42 toward the leeward region 46 into the two parts 72, 77. The upper part 77 preferably includes the portion 86 and the second part 75, which are mixed together to at least partially form the upper part 77, as described above. Also, once the polluted air is divided, the wall assembly 40 directs the two parts 72, 77 along separate paths. The lower, or first part 72 preferably is directed into the first channel 68, and thereby directed upwardly by the first channel 68 substantially orthogonally to the ground (i.e., the first channel 68 preferably is substantially vertical).

While the first part 72 is directed into the first channel 68 and through the first channel as described above, the upper part 77 passes over the deflector 74 and flows past the opening 87 of the first channel 68, substantially in a flow direction toward the leeward region 46.

The first part 72 flows upwardly as it exits the wall assembly 40 (i.e., via the upper opening 87), and flows upwardly when it pushes into the upper part 77, thereby causing both parts 72, 77 to be mixed together resulting in improved dispersion of the polluted air. The flow direction is substantially transverse to the first channel 68, and vice versa. The flow direction is schematically represented by arrow $O_F$ in FIG. 3, generally at 91 thereon.

As described above, the polluted air (i.e., the first, or lower, part 72) and the less polluted air (i.e., the upper part 77) are mixed together to result in moderately polluted air schematically represented at Y on arrows $O_J$, $O_F$, $O_G$, and $O_H$ in FIG. 3.

Polluted air originating generally from the lower source is schematically represented by arrows identified in FIG. 3 as $O_A$ and $O_B$. As indicated in FIG. 3, the polluted air originating from lower sources is directed generally to the aperture 70 and, after passing through the aperture 70 and into the second channel 78, into the first channel 68. Wind flow (i.e., the moving first part 72) into the first channel 68 is deflected upwardly by the outer wall channel surface 88, and pushed upwardly through the first channel 68 to exit the first channel 68 via its upper opening 87.

Polluted air originating generally from upper sources (and also partially from lower sources) is schematically represented by arrows identified in FIG. 3 as $O_C$, $O_D$, $O_E$, and $O_F$. As illustrated in FIG. 3, the polluted air represented by $O_C$ and $O_D$ is directed upwardly by the exposed inner wall surface 80 and the deflector 74. The wind flow represented by $O_C$ and $O_D$ is blocked by the lower portion 58 of the inner wall 56, and a relatively high windward positive pressure develops as a result in the region designated as $A_1$. However, the polluted air represented by $O_C$ and $O_D$ generally is directed upwardly and over the deflector, to be included in the second part 86. Also, the polluted air represented by arrows $O_E$, and $O_F$ pass over the upper end 82 of the deflector 74, also to be included in the second part 86, with the polluted air represented by $O_G$ and $O_H$. FIG. 3 also shows less polluted air from higher elevations in the roadway region, represented by arrows $O_G$ and $O_H$, as passing over the deflector 74. In the region $A_2$ which is leeward of the deflector 74, wind flow is separated, creating turbulence.

Based on the foregoing, it can be seen in FIG. 3 that the flowing polluted air schematically represented by the arrows $O_A$ and $O_B$ is included in the first part 72 and the flowing polluted air schematically represented by the arrows $O_C$-$O_H$ generally is included in the second part 86.

At $A_3$, the flow of the first part 72 upwardly through the first channel 68 is partly drawn up by the second part 86 moving substantially in the flow direction across the upper end 87 of the first channel 68 and the first part 72 pushes upwardly in a direction substantially transverse to the flow direction of the upper part 77, reducing the negative pressure at $A_2$ and lifting the plume path across the outer wall 48 (FIG. 3). As can be seen in FIG. 3, the vertical plume rise is further enhanced by the flow of the first part 72 upwardly out of the first channel 68, thereby lofting the roadway pollutants (i.e., both from the first part 72 and the upper part 77) higher up into the air, for dispersion enhancement.

As can be seen in FIG. 3, arrows $O_F$, $O_G$, and $O_H$ are shown to be pushed upwardly (at 91 $O_F$ and at "X" on $O_G$, and $O_H$). In comparison the flow of upper portions of the polluted air over the prior art walls 10, 12 (as shown in FIGS. 1B and 2), the arrows $O_F$, $O_G$, and $O_H$ in FIG. 3 show far more vertical mixing and dispersion.

As shown in FIG. 3, the polluted air above the wall assembly 40 (i.e., the polluted air schematically represented by arrows $O_G$, $O_H$) are significantly disrupted and pushed up to a higher elevation due to vertical ejection (i.e., updraft) of the part 72 from internal channel 68. Stronger separation in $A_2$ and turbulence in $A_3$ due to the upward movement of the part 72 also cause strong vertical mixing above the wall.

Figure 1A:
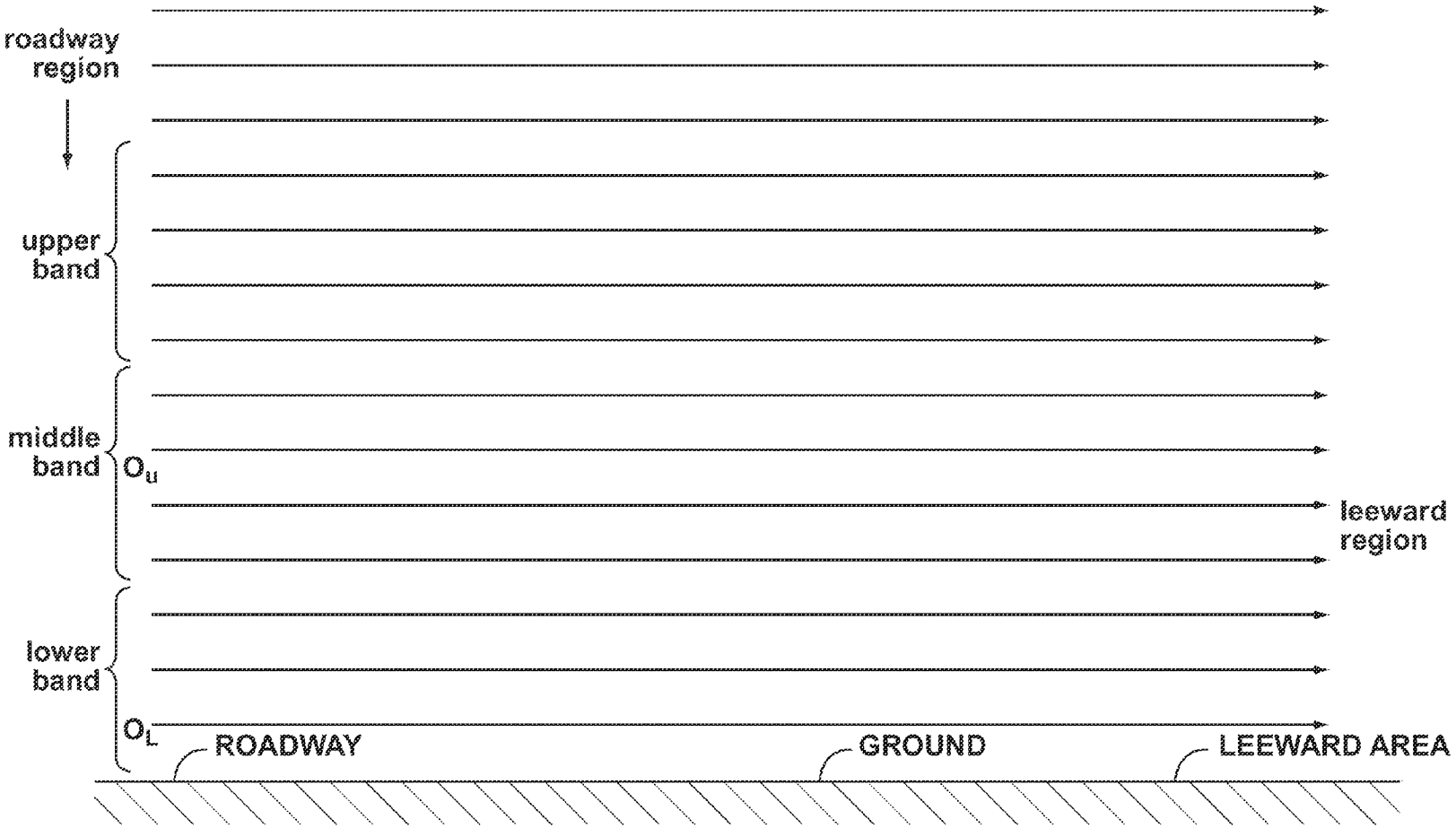
FIG. 1A (Prior Art)
FIG. 1A (also described previously) is a schematic diagram showing the flow of air from a roadway region to a leeward region in the absence of an obstruction, based on computational fluid dynamics modelling.
Figure 1B:
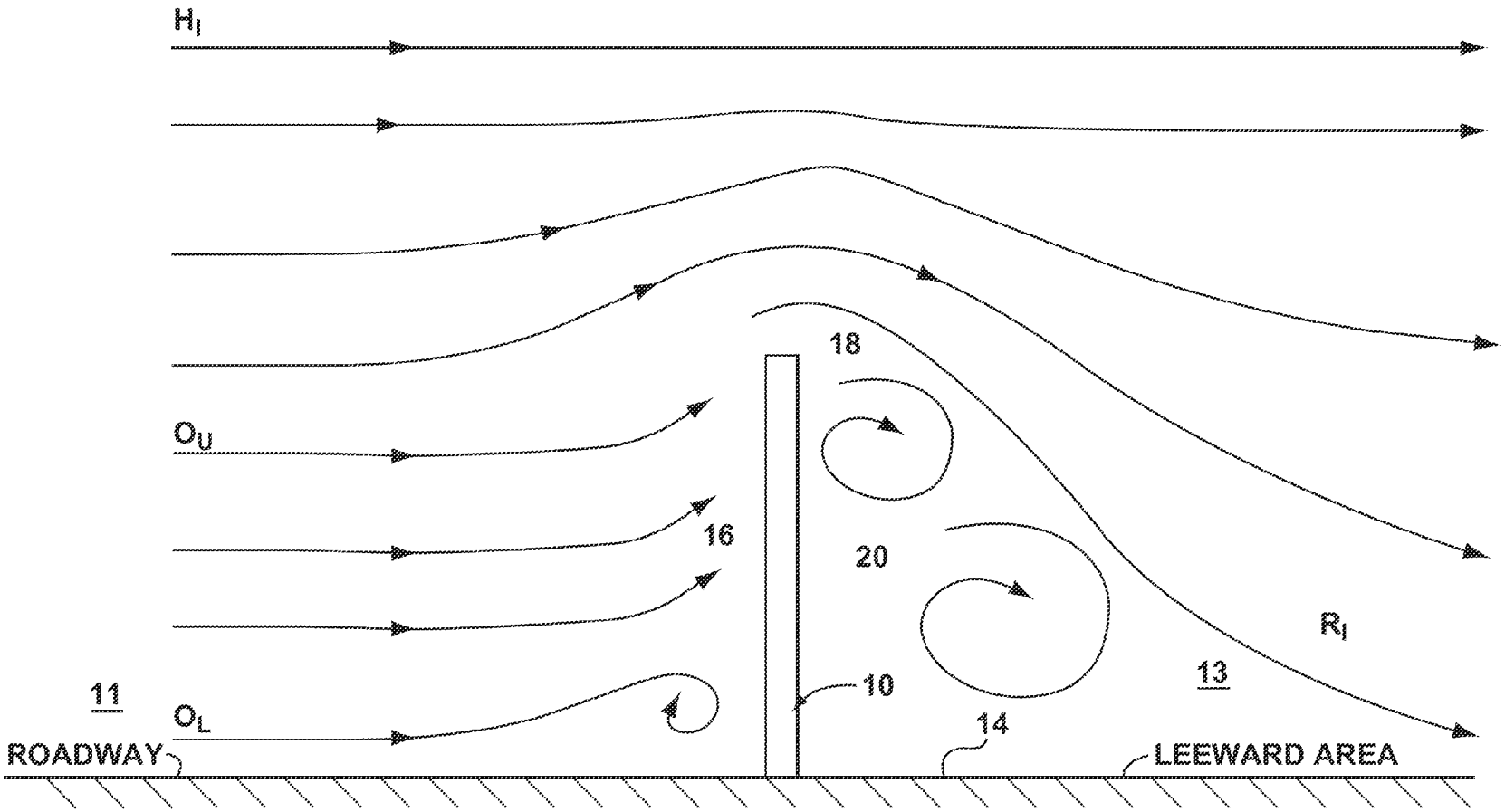
FIG. 1B (PRIOR ART)
FIG. 1B (also described previously) is a schematic diagram showing the effect of a prior art wall on movement of polluted air from a roadway region toward a leeward region, based on computational fluid dynamics modelling.

Finally, FIG. 3 shows the wake effect at $A_4$ in the leeward region 46 is somewhat reduced from that shown in FIG. 1B, referring to the prior art wall 10. This reduction in the wake effect appears to be largely due to the turbulence at $A_2$ and the upward movement of polluted air from the first channel 68. Accordingly, as compared to the effect of the prior art wall disclosed in FIG. 1B, the roadway pollutants are reduced at receptor "$R_3$" (FIG. 3).

In one embodiment, the wall assembly 40 preferably also includes one or more pollution treatment devices 92 (FIG. 4) positioned for treatment of the first part 72 of the polluted air as the first part 72 moves through the first channel 68.

Preferably, the pollution treatment devices are mounted so that polluted air is directed through the devices 92, thereby further improving the air quality downwind of the wall. As an example, filters can be used as passive pollution control devices while water sprays can be used as active pollution control devices. Those skilled in the art would be aware of various pollution treatment devices which would be suitable.

Figure 5:
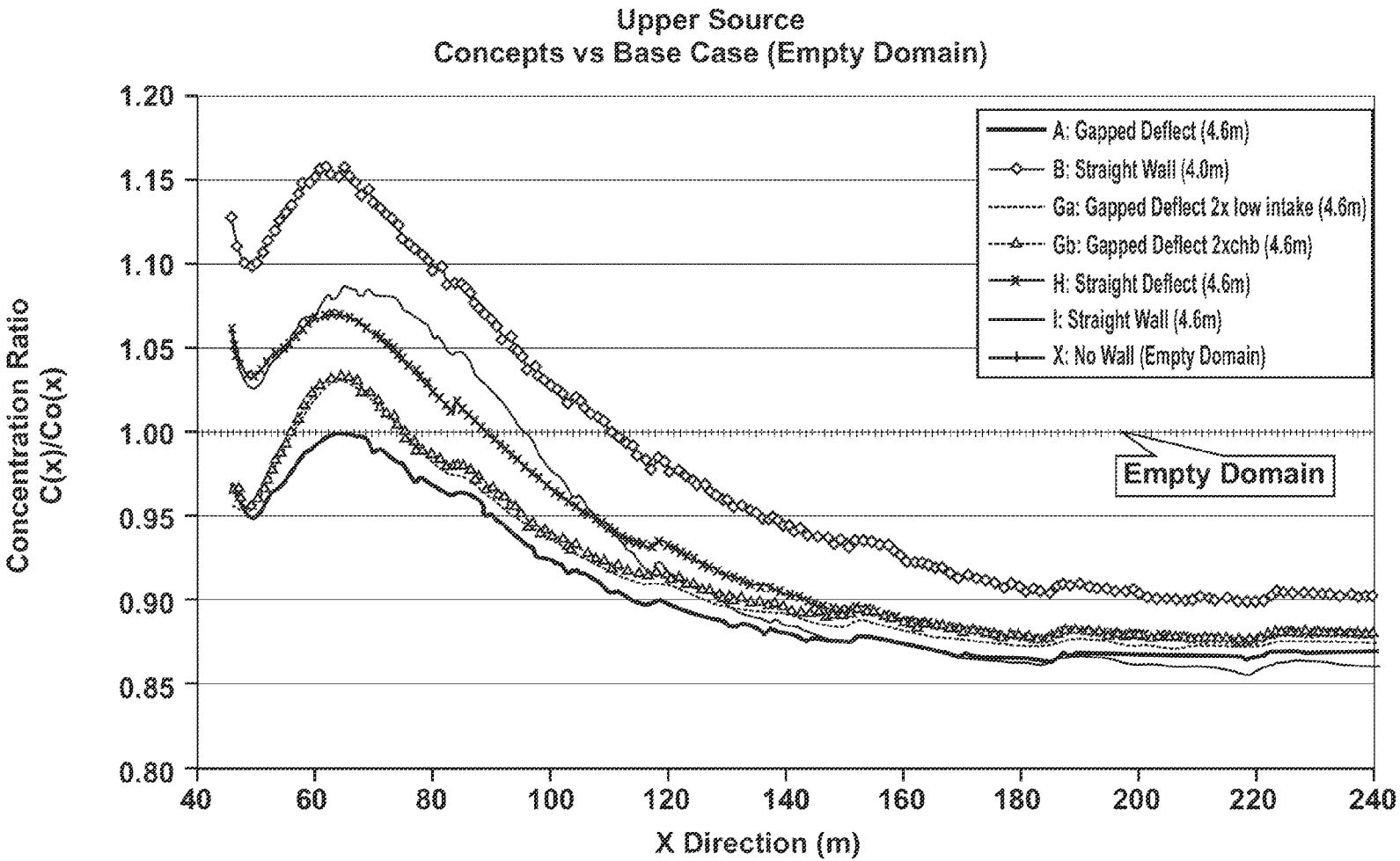
FIG. 5 is a graph showing concentration ratio as a function of distance from an outer wall of the wall assembly of FIG. 4, and corresponding data for various other configurations of walls (including certain prior art walls), where the polluted air is from an upper source.
Figure 6:
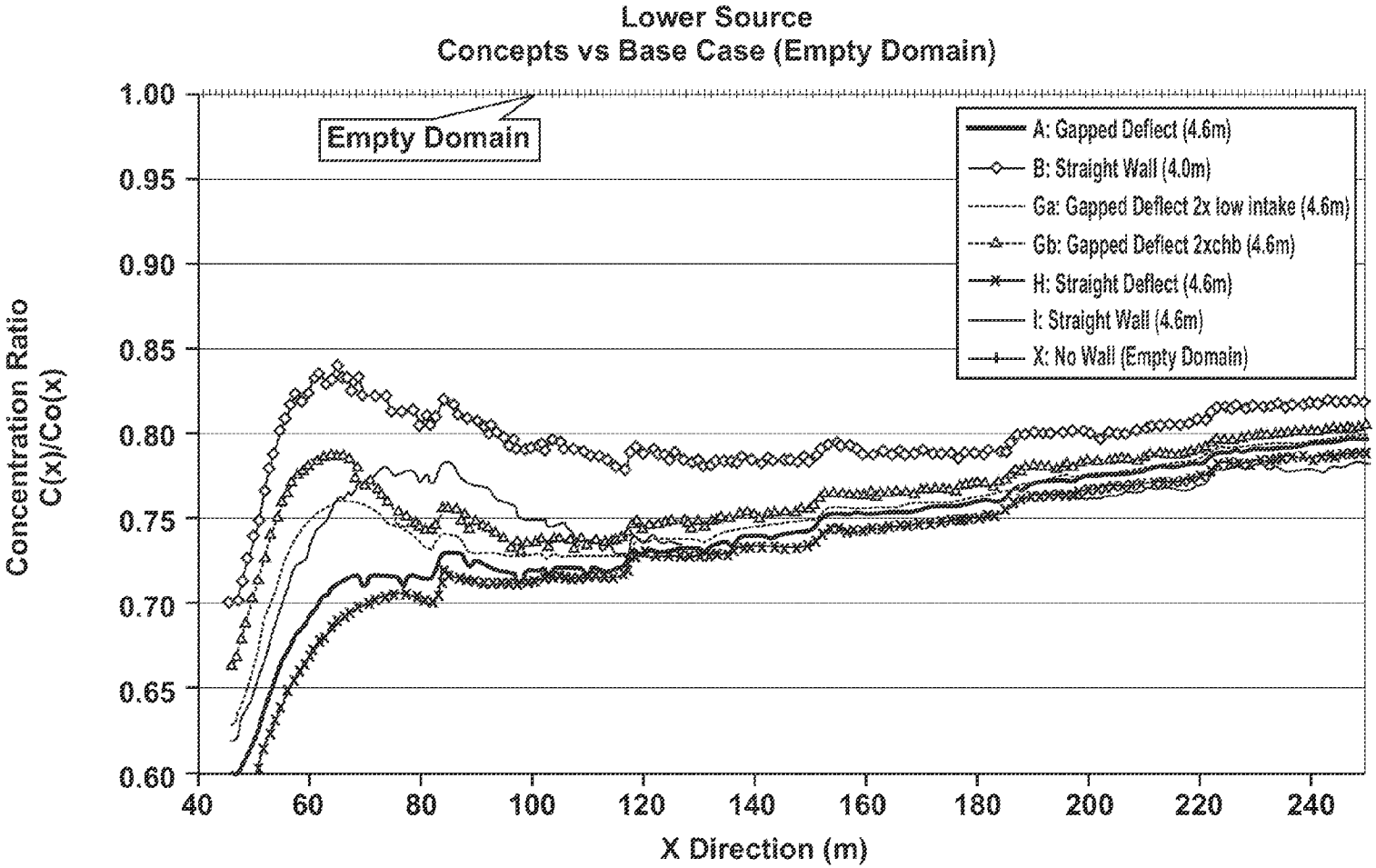
FIG. 6 is a graph showing concentration ratio as a function of distance from the outer wall of the wall assembly of FIG. 4, and corresponding data for various other configurations of walls (including certain prior art walls), where the polluted air is from a lower source.
Figure 7:
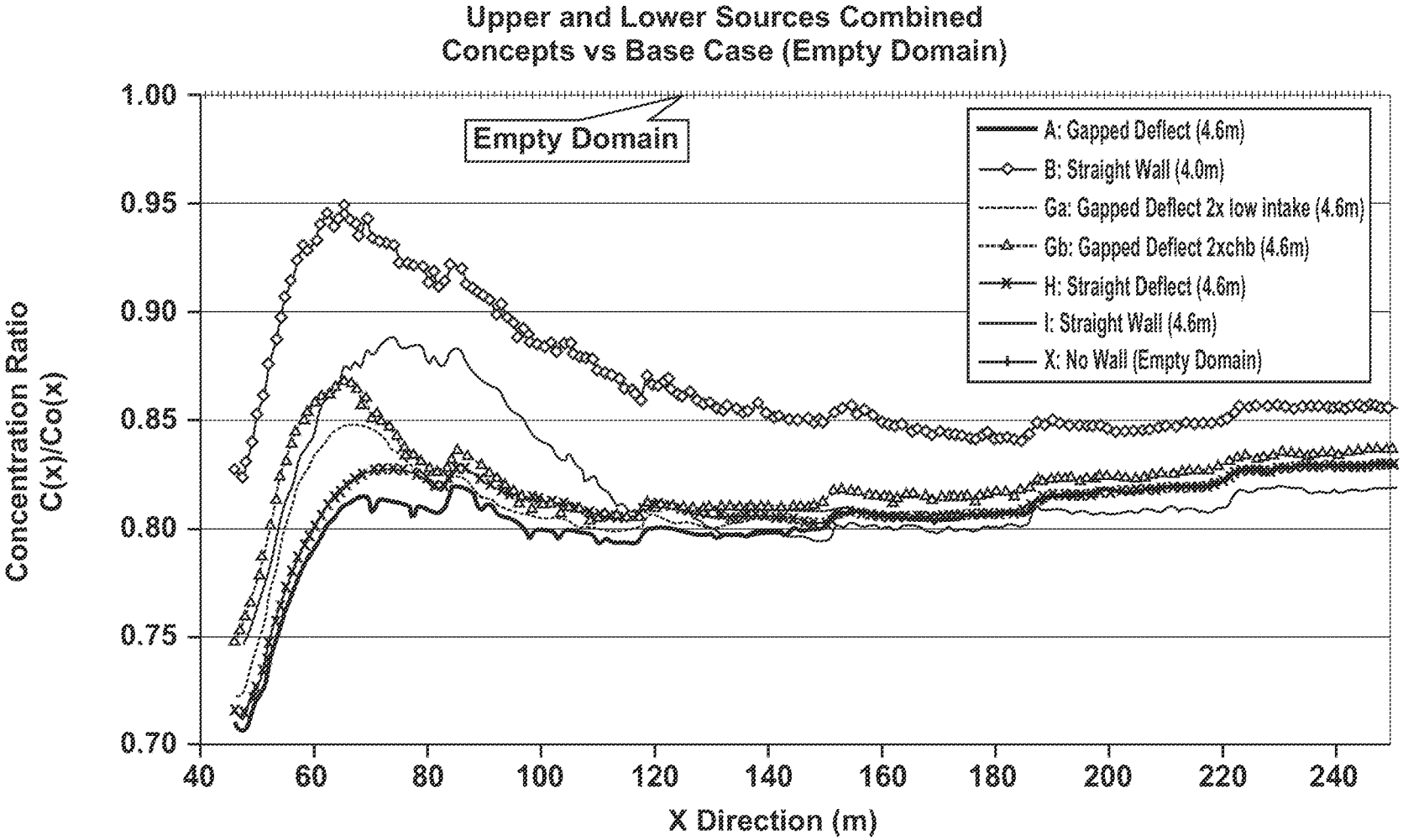
FIG. 7 is a graph showing concentration ratio as a function of distance from the outer wall of the wall assembly of FIG. 4, and corresponding data for various other configurations of walls (including certain prior art walls), where the polluted air is from combined upper and lower sources.

Graphs showing the concentrations of the roadway pollutants in the leeward region, as a function of distance from the roadway in a variety of cases, are provided in FIGS. 5-7. As will be described, the concentrations of the roadway pollutants are provided as concentration ratios, i.e., the concentrations in each case are compared to the concentrations in a base case. In FIGS. 5-7, the data presented is the result of analysis using computational fluid dynamics software to model the flow of polluted air in each of the following cases respectively:

(a) Case A is the wall assembly 40 of the invention, in which (referring to FIG. 4):

$\theta$ is approximately 135°;

$\delta_i$ is approximately 0.5 meters;

$\delta_g$ is approximately 0.2 meters;

$\delta_h$ is approximately 4.0 meters;

$\delta_t$ is approximately 4.6 meters;

(b) Case B is a straight wall, i.e., as shown in FIG. 1B, having a height from the ground to the upper end thereof of approximately 4 m.;

(c) Case Ga is the wall assembly 40 in which the aperture 70 is approximately 1 m. high, but the dimensions thereof are otherwise substantially identical to the dimensions of the wall assembly 40 identified above as Case A;

(d) Case Gb is the wall assembly 40 in which the width of the first channel 68 is 0.4 m., but the dimensions thereof are otherwise substantially identical to the dimensions of the wall assembly 40 identified above as Case A;

(e) Case H is the prior art wall 12 as shown in FIG. 2, in which the distance from the ground to the upper end thereof is 4.6 m.;

(f) Case I is the prior art straight wall 10 as shown in FIG. 1B, however, with a height of 4.6 m.

To evaluate the effect of the various wall configurations described above on air quality in the leeward region as compared to a base case, concentration ratios ($C_{(x)}/Co_{(x)}$) were determined using computational fluid dynamics software. In each of FIGS. 5-7, the base case is no wall (i.e., the circumstances shown in FIG. 1A). The concentration ratio is the ratio of (i) $C_{(x)}$, being the concentration of the roadway pollutants at a specified location (i.e., a distance from the roadway region) in the leeward area at about 1.5 meters above ground level when a particular wall design is used, to (ii) $Co_{(x)}$, being the concentration of the roadway pollutants at the specified location in the leeward area at about 1.5 meters above ground level in the base case. (As described above, the position of about 1.5 meters above ground level is selected because adult human beings typically breath at about this height).

From the foregoing, it follows that, as can be seen in FIG. 5, the base case of an empty domain (i.e., as shown in FIG. 1A) results in a concentration ratio of 1.0.

In FIGS. 5-7, the horizontal axis values are the distance from the roadway. In FIG. 5, only the upper source is considered. Case B (the prior art noise wall 10 shown in FIG. 1B) is shown to have the effect of significantly increasing the concentration ratio within approximately 110 meters of the roadway, when the roadway pollutants originate from the upper source. Also, in these circumstances, Case H (the prior art wall 12 shown in FIG. 2) increases the concentration ratio within approximately 90 meters of the roadway.

From FIG. 5, therefore, it can be seen that, where the upper source alone is the source of the roadway pollutants, the prior art noise walls (10, 12) significantly worsen the concentration ratio within approximately 90-110 meters of the roadway, in the leeward area. Specifically, the concentration ratio is increased up to approximately 1.07 for Case H and up to approximately 1.15 for Case B.

FIG. 5 also shows that Case A, which represents an embodiment of the wall assembly 40 of the invention herein, significantly improves the concentration ratios (i.e., as compared with the base case, and all other cases) within approximately 130 meters of the roadway. Case A results in concentration ratios generally lower than those of the base case. Therefore, in the part of the leeward area (i.e., within approximately 110 m.) where the prior art walls cause significantly high concentration ratios, the wall assembly 40 provides much better results.

This represents a significant improvement in the part of the leeward area (i.e., within about 130 meters (approximately 427 ft.) of the roadway), where improvement is most needed, in those situations where a prior art noise wall described as either Case B or Case H is used.

Additional data is presented in FIG. 6, for polluted air originating at the lower source. Case B does not result in higher concentration ratios than the base case where the roadway pollutants originate at the lower source. Within approximately 100 meters of the roadway, the wall assembly 40 (Case A) provides a better result than Case B, but somewhat higher concentration ratios than Case H.

The modelling results for combined upper and lower sources are shown in FIG. 7. In this modelling, equal volumes of the polluted air are assumed to originate from the lower and upper sources. As can be seen in FIG. 7, the wall assembly 40 is shown to provide the best performance in general. The only exception to this is in the region of approximately 160 meters and further from the roadway. As noted above, however, in the area approximately 160 meters and more from the roadway, mitigation is not particularly required, i.e., as compared to the situation resulting from the prior art walls 10, 12.

In summary, the wall assembly 40 (FIGS. 3 and 4) results in better performance over the prior art walls shown in FIGS. 1B and 2, due to: (a) the deflector 74 creates extra separation and turbulence in the leeward region 46; (b) the first channel 68 creates vertical exhaust and ejects polluted air upwards to higher elevations; and (c) the combination of (a) and (b)

results in vertical mechanical mixing and substantially eliminates the wake effect on the lee side, to further reduce concentration on the lee side.

From the foregoing, it appears that in the optimal design, the parameters disclosed in FIG. 4 are as follows:

$\theta$: 135°;

$\delta_i$: 0.5 meters;

$\delta_g$: 0.2 meters;

$\delta_h$: 4.0 meters; and $\delta_t$: 4.6 meters.

Additional embodiments of the invention are shown in FIGS. 8-11. In FIGS. 8-11, elements are numbered so as to correspond to like elements shown in FIGS. 3 and 4.

Figure 8:
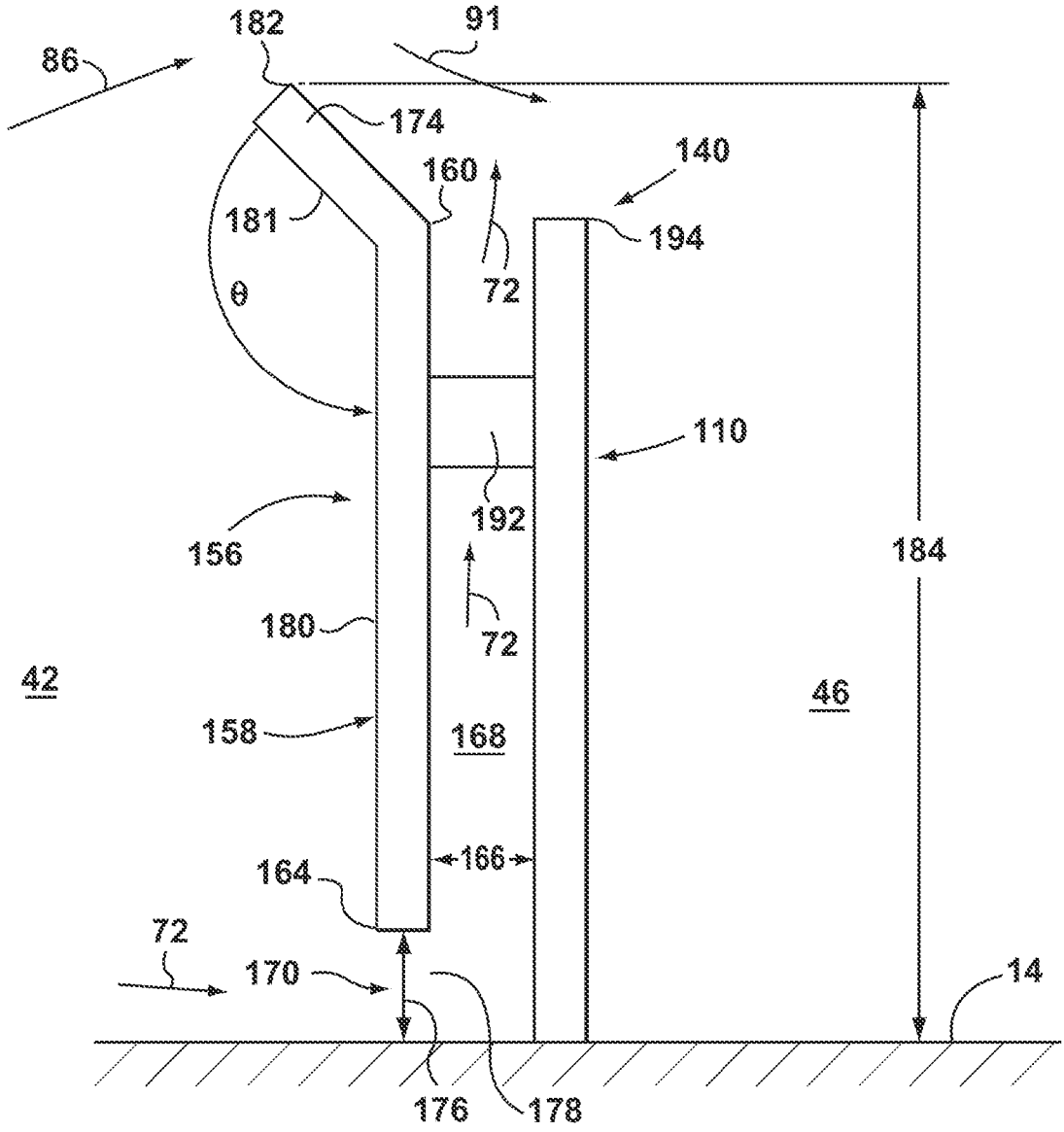
FIG. 8 is a cross-section of an alternative embodiment of the wall assembly of the invention.
Figure 9:
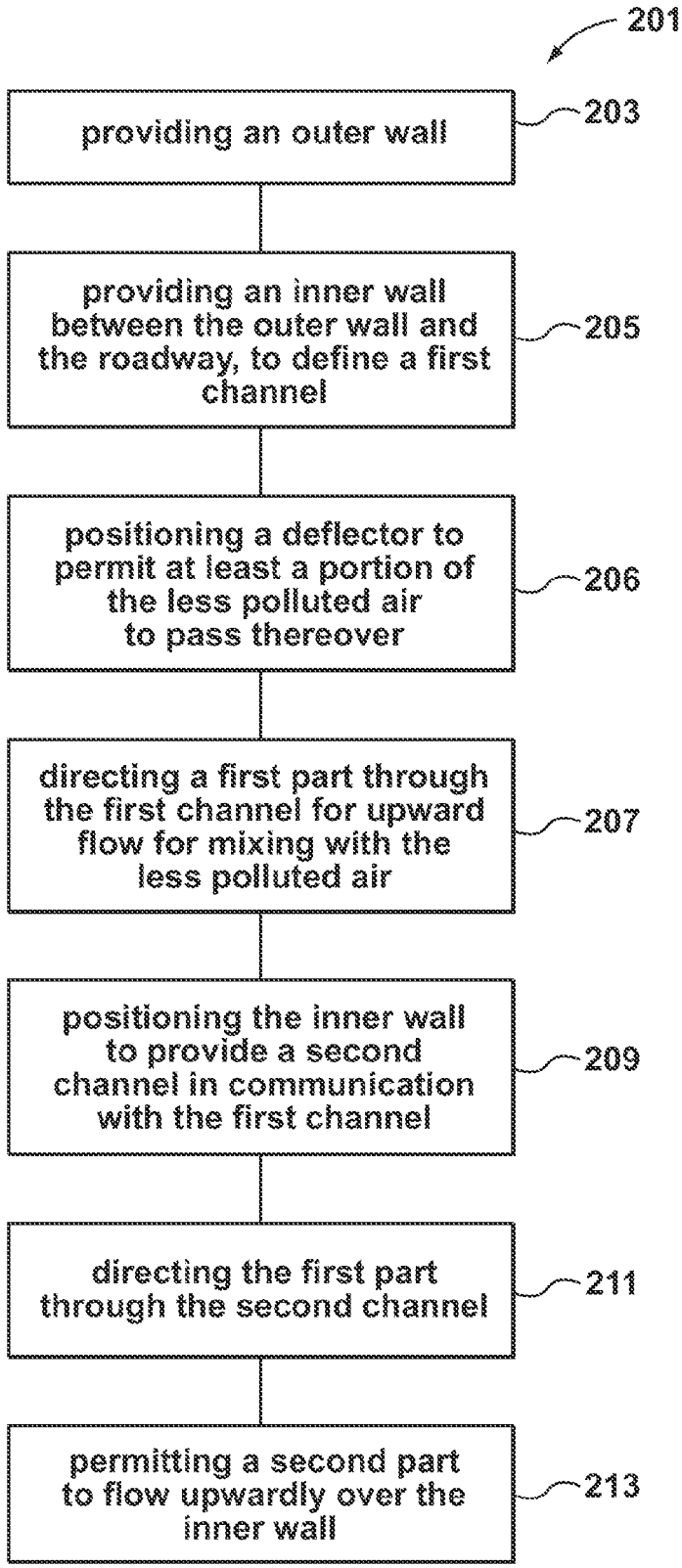
FIG. 9 is a schematic illustration of an embodiment of a method of the invention.

In another embodiment, as shown in FIG. 8, the invention provides an inner wall 156 for positioning relative to an existing outer wall 110 to provide a wall assembly 140 for mixing polluted air with less polluted air to provide moderately polluted air. The polluted air includes one or more roadway pollutants in one or more elevated concentrations moving from the roadway region proximal to a roadway toward the leeward region substantially above a leeward area. The less polluted air includes the roadway pollutant(s) in one or more lower concentrations located distal to the roadway. The moderately polluted air includes the roadway pollutant (s) at a reduced concentration disposed proximal to the leeward area. The existing outer wall 110 has an upper end 194 positioned at a first height above the ground.

The inner wall 156 preferably includes a lower portion 158 positionable between the roadway and the outer wall. The lower portion 158 preferably includes a top end 160 thereof positioned at a second height above the ground. It is preferred that the second height is substantially equal to the first height. The lower portion 158 extends between the top end 160 and the bottom end 164. The lower portion 158 preferably is positionable spaced apart from the outer wall 110 by one or more preselected distances 166 to at least partially define a first channel 168 therebetween. Preferably, the inner wall also includes a deflector 174 positioned at the top end 160 of the lower portion 158, the deflector including an upper end 182 thereof positioned at a first preselected height above the ground to permit at least a portion of the less polluted air to pass over the upper end while the less polluted air moves from the road region toward the leeward region. It is also preferred that the lower portion 158 is formed to at least partially define one or more apertures 170 for directing the first part 72 of the polluted air into the first channel 168 so that the first part 72 is directed substantially upwardly thereby to mix with the less polluted air to provide the moderately polluted air proximal to the leeward area.

It will be appreciated by those skilled in the art that the inner wall 156 is adapted for retrofitting to the existing wall 110. Preferably, the inner wall 156 is mounted and/or positioned relative to the wall 110 in any suitable manner.

Preferably, the bottom end 164 of the lower portion 158 is positionable at the second preselected height 176 above the ground to at least partially define the aperture 170 and a second channel 178 in communication therewith, for directing the first part 72 of the polluted air into the first channel.

In one embodiment, the lower portion includes an exposed inner wall surface 180 adapted to direct the part of the polluted air substantially upwardly. Preferably, the deflector and the exposed inner wall surface 180 substantially define an obtuse dihedral angle $\theta$ therebetween which is substantially facing the roadway region (FIG. 8).

In one embodiment, the deflector 174 is positionable at a second preselected height 184 above the ground so that the deflector 174 permits the second part to pass above the deflector 174 and over the first channel 168, for mixture with the first part of the polluted air once the first part exits the first channel, for dispersal of the polluted air.

In another embodiment, the inner wall 156 additionally comprises one or more pollution treatment devices 192 positioned for treatment of the first part of the polluted air as the first part moves through the first channel 168.

The inner and outer walls may be made of any suitable materials. Preferably, the walls are made of an absorptive or reflective noise attenuating material. Any suitable such material may be used. For example, the walls may be made of concrete, metal, brick or Durisol®, or any combination(s) thereof. It will be understood that the means of supporting the inner wall are not shown in FIGS. 3 and 4 to simplify the drawings. It will also be understood that only the wall assembly positioned on one side of a roadway is shown, for convenience. Preferably, wall assemblies are positioned on both sides respectively of the roadway.

In use, an embodiment of a method 201 of the invention includes, first, providing an outer wall spaced apart from the roadway (FIG. 9, step 203) and, next, providing an inner wall disposed between the roadway and the outer wall (step 205). The inner wall preferably is spaced apart from the outer wall to at least partially define a first channel therebetween, as previously described. The inner wall preferably includes a lower portion with a deflector at a top end thereof, as previously described. The lower portion at least partially defines one or more apertures for directing the first part 72 of the polluted air into the first channel. The deflector is positioned to allow at least a portion of the less polluted air to pass thereover (step 206). The method preferably also includes directing the first part of the polluted air through the first channel so that the first part is directed upwardly for mixing thereof with the less polluted air, to provide moderately polluted air proximal to the leeward area (step 207).

Preferably, the method also includes the steps of positioning the bottom end of the lower portion at a second preselected height above the ground to at least partially define the aperture and a second channel in communication therewith (step 209), and directing the first part of the polluted air through the aperture and the second channel into the first channel (step 211). In addition, the method preferably includes positioning an upper end of the deflector at a second preselected height so that the deflector permits a second part of the polluted air to pass upwardly over the deflector toward the leeward region (step 213).

Figure 10:
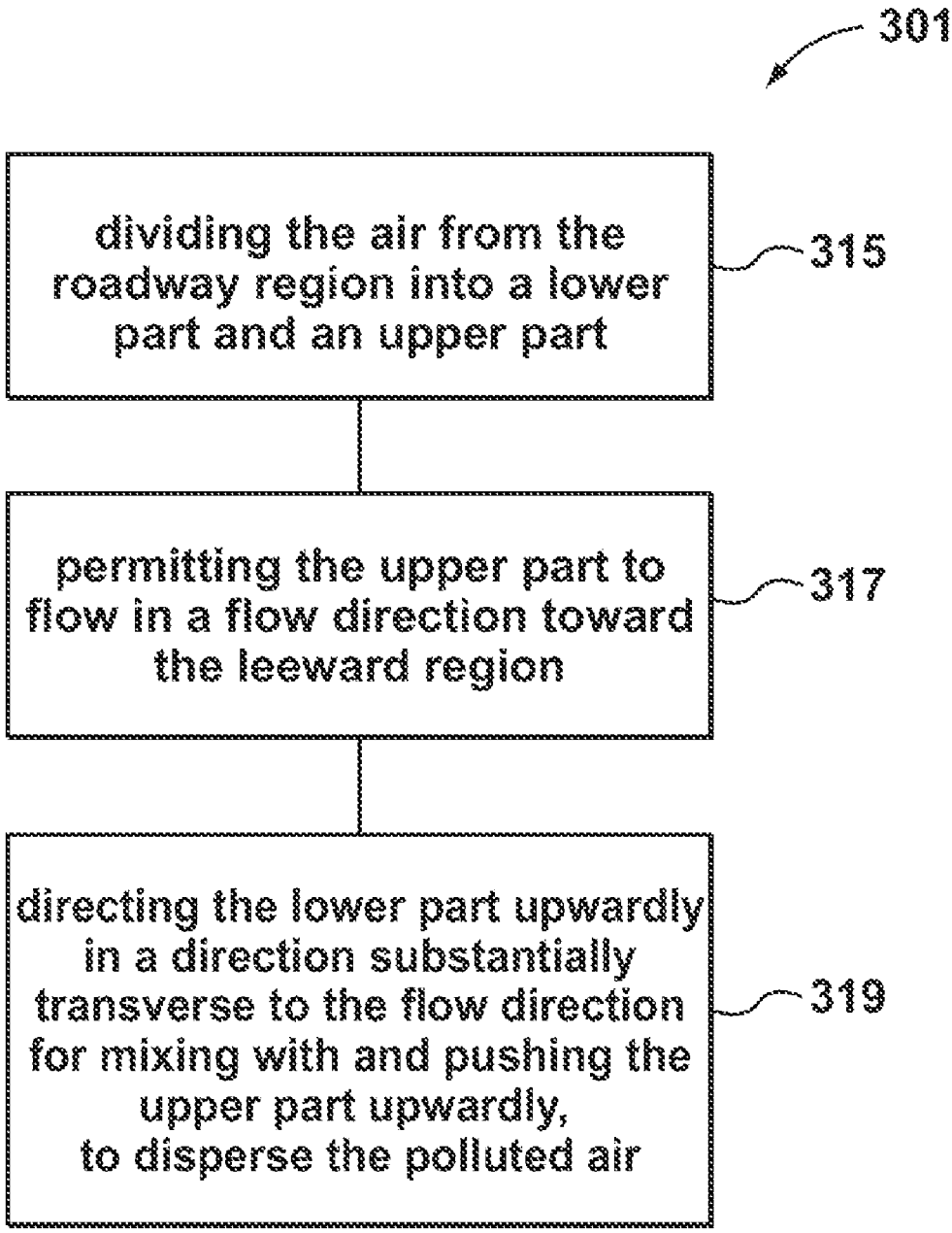
FIG. 10 is a schematic illustration of an alternative embodiment of a method of the invention.

In another embodiment of a method 301 of the invention, the method preferably includes, first, dividing air from the roadway region into a lower part and an upper part (FIG. 10, step 315). The upper part preferably is permitted to flow substantially in one or more flow directions toward the leeward region (step 317). Also, the lower part preferably is directed in a direction substantially transverse to the flow direction(s) to intersect with the upper part, mixing therewith and pushing the upper part upwardly for dispersal of the polluted air over the leeward region (step 319).

Figure 11:
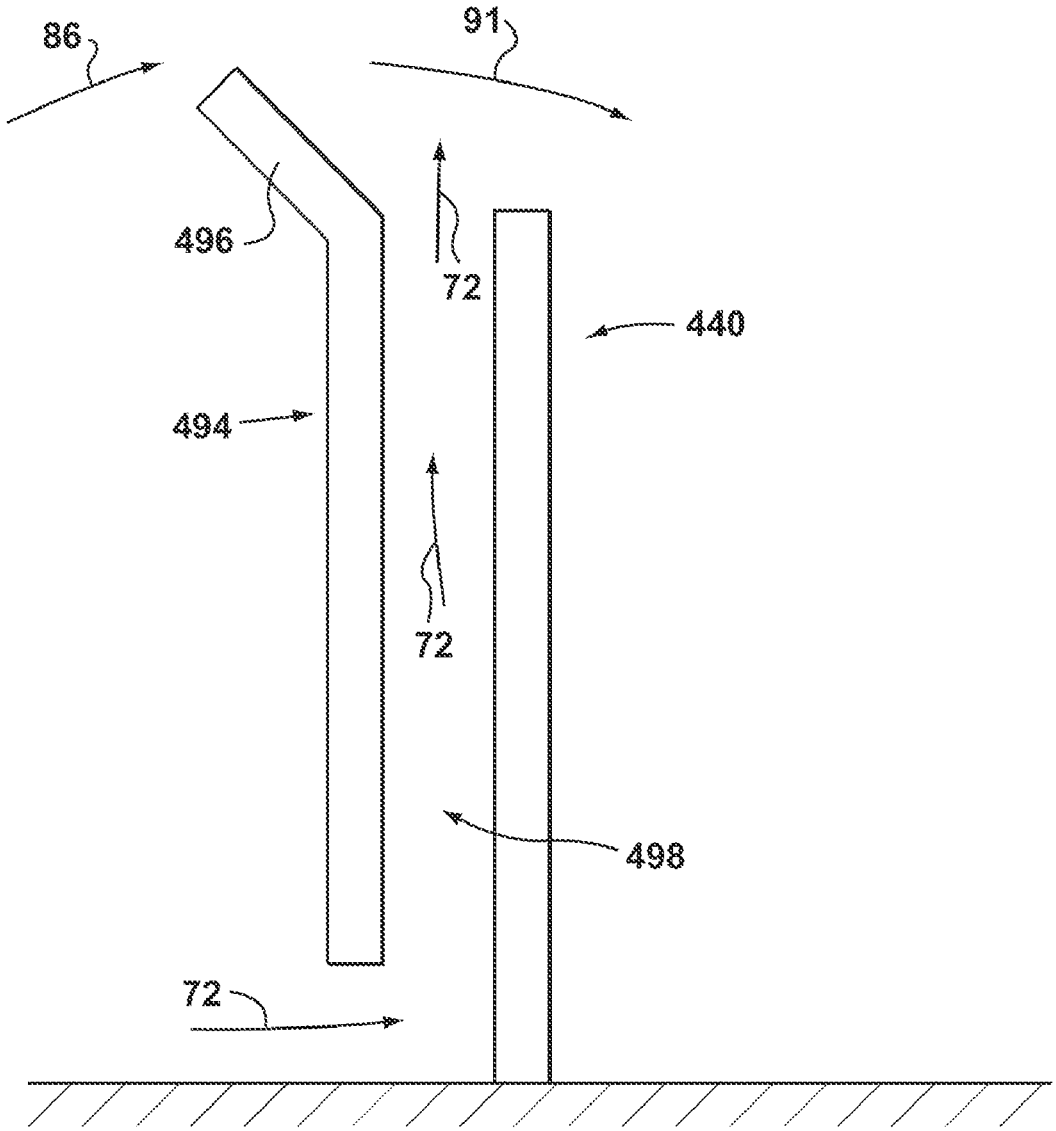
FIG. 11 is a cross-section of another embodiment of the wall assembly of the invention.

In one embodiment, as can be seen in FIG. 11, a wall assembly 440 of the invention includes means 494 for dividing air from the roadway region into the lower part 72 and the upper part 86. The wall assembly 440 also includes means 496 for allowing the upper part 86 to pass over the deflector 74, to flow substantially in the flow direction(s) toward the leeward region 46. (The flow direction is schematically represented by arrow 91 in FIG. 11.) Also, the wall assembly 440 includes means 498 for directing the lower part upwardly in a direction substantially transverse to the flow direction(s) to intersect with the upper part 86, to mix with the upper part and to push the second part upwardly for dispersing the polluted air over the leeward region 46.

Any element in a claim that does not explicitly state "means for" performing a specific function, or "step for" performing a specific function, is not to be interpreted as a "means" or "step" clause as specified in 35 U.S.C. §112, paragraph 6.

It will be appreciated by those skilled in the art that the invention can take many forms, and that such forms are within the scope of the invention as claimed. The foregoing descriptions are exemplary, and their scope should not be limited to the specific versions described therein.

We claim:

1. A wall assembly for mixing polluted air with less polluted air to provide moderately polluted air, the polluted air comprising at least one roadway pollutant in at least one elevated concentration moving from a roadway region above a roadway toward a leeward region above a leeward area, the less polluted air comprising said at least one roadway pollutant in at least one lower concentration located distal to the roadway, and the moderately polluted air comprising said at least one roadway pollutant at a reduced concentration disposed proximal to the leeward area, the wall assembly comprising:

an outer wall spaced apart from the roadway with an upper end thereof positioned a first predetermined height above the ground;

an inner wall disposed between the roadway and the outer wall and comprising a lower portion with a top end thereof positioned a second predetermined height above the ground, the lower portion extending between the top end and a bottom end thereof, the lower portion being spaced apart from the outer wall by at least one preselected distance to at least partially define a first channel therebetween;

the inner wall additionally comprising a deflector positioned at the top end of the lower portion, the deflector comprising an upper end thereof positioned at a first preselected height above the ground to permit at least a portion of said less polluted air to pass over the upper end while the less polluted air moves from the roadway region toward the leeward region; and the lower portion being formed to at least partially define at least one aperture for directing a first part of said polluted air into the first channel, such that said first part of said polluted air is directed substantially upwardly thereby to mix with said less polluted air to provide said moderately polluted air proximal to the leeward area.

2. A wall assembly according to claim 1 in which the first and second predetermined heights are substantially equal.

3. A wall assembly according to claim 1 in which the bottom end of the lower portion of the inner wall is positioned a second preselected height above the ground to at least partially define said at least one aperture and a second channel in communication therewith and in communication with the first channel, for directing said first part of said polluted air into the first channel.

4. A wall assembly according to claim 1 in which the deflector is positioned for directing at least a second part of said polluted air substantially upwardly, for mixing with said less polluted air.

5. A wall assembly according to claim 1 in which the lower portion comprises an exposed inner wall surface adapted to direct said second part of said polluted air substantially upwardly for mixing thereof with said less polluted air.

6. A wall assembly according to claim 5 in which the deflector and the exposed inner wall surface substantially define an obtuse dihedral angle therebetween substantially facing the roadway region.

7. A wall assembly according to claim 6 in which the dihedral angle is approximately 135°.

8. A wall assembly according to claim 1 in which the outer wall comprises an outer wall channel surface and the inner wall comprises an inner wall channel surface facing the outer wall channel surface, the inner wall channel surface and the outer wall channel surface at least partially defining the first channel.

9. A wall assembly according to claim 1 additionally comprising at least one pollution treatment device positioned for treatment of said first part of said polluted air as said first part of said polluted air moves through the first channel.

10. An inner wall for positioning relative to an outer wall to provide a wall assembly for mixing polluted air with less polluted air to provide moderately polluted air, the polluted air comprising at least one roadway pollutant in at least one elevated concentration moving from a roadway region proximal to a roadway toward a leeward region substantially above a leeward area, the less polluted air comprising said at least one roadway pollutant in at least one lower concentration located distal to the roadway, and the moderately polluted air comprising said at least one roadway pollutant at a reduced concentration disposed proximal to the leeward area, the outer wall including an upper end thereof positioned a first height above the ground, the inner wall comprising:

a lower portion positionable between the roadway and the outer wall, the lower portion comprising a top end thereof positioned at a second height above the ground, the second height being substantially equal to the first height, the lower portion extending between the upper end and a bottom end thereof;

the lower portion being positionable spaced apart from the outer wall by at least one preselected distance to at least partially define a first channel therebetween;

a deflector positioned at the top end of the lower portion, the deflector comprising an upper end thereof positioned at a first preselected height above the ground to permit at least a portion of said less polluted air to pass over the upper end while the less polluted air moves from the roadway region toward the leeward region; and the lower portion being formed to at least partially define at least one aperture for directing a first part of said polluted air into the first channel, such that said first part of said polluted air is directed substantially upwardly thereby to mix with said less polluted air to provide said moderately polluted air proximal to said leeward area.

11. An inner wall according to claim 10 in which the bottom end of the lower portion is positionable at a second preselected height above the ground to at least partially define said at least one aperture and a second channel in communication therewith, for directing said first part of said polluted air into the first channel.

12. An inner wall according to claim 10 in which the deflector is positioned for directing at least a second part of said polluted air substantially upwardly, for mixing with said less polluted air.

13. An inner wall according to claim 10 in which the lower portion comprises an exposed inner wall surface adapted to direct said second part of said polluted air substantially upwardly for mixing thereof with said less polluted air.

14. An inner wall according to claim 13 in which the deflector and the exposed inner wall surface substantially define an obtuse dihedral angle therebetween substantially facing the roadway region.

15. An inner wall according to claim 14 in which the dihedral angle is approximately 135°.

16. An inner wall according to claim 10 additionally comprising at least one pollution treatment device positioned for treatment of said first part of said polluted air as said first part of said polluted air moves through the first channel.

17. A wall assembly for mixing polluted air with less polluted air to provide moderately polluted air, the polluted air comprising at least one roadway pollutant in at least one elevated concentration moving from a roadway region proximal to a roadway toward a leeward region substantially above a leeward area, the less polluted air comprising said at least one roadway pollutant in at least one lower concentration located distal to the roadway, and the moderately polluted air comprising said at least one roadway pollutant at a reduced concentration disposed proximal to the leeward area, the wall assembly comprising:

means for dividing air from the roadway region into a lower part and an upper part;

means for permitting at least a portion of the upper part to flow substantially in at least one flow direction toward the leeward region; and means for directing the lower part substantially upwardly in a direction substantially transverse to said at least one flow direction to intersect with the upper part and to mix the polluted air with said less polluted air, to provide said moderately polluted air proximal to the leeward area.

* * * * *